US009242833B2

(12) United States Patent
Hirabayashi

(10) Patent No.: US 9,242,833 B2
(45) Date of Patent: Jan. 26, 2016

(54) CONTROL DEVICE OF ELEVATOR

(75) Inventor: Kazufumi Hirabayashi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 531 days.

(21) Appl. No.: 13/813,966

(22) PCT Filed: Sep. 6, 2010

(86) PCT No.: PCT/JP2010/065231
§ 371 (c)(1),
(2), (4) Date: Feb. 4, 2013

(87) PCT Pub. No.: WO2012/032593
PCT Pub. Date: Mar. 15, 2012

(65) Prior Publication Data

US 2013/0126276 A1 May 23, 2013

(51) Int. Cl.
*B66B 1/28* (2006.01)
*B66B 1/30* (2006.01)

(52) U.S. Cl.
CPC .. *B66B 1/30* (2013.01); *B66B 1/304* (2013.01)

(58) Field of Classification Search
CPC ..... B66B 1/30; B66B 1/304
USPC ..... 187/247, 277, 293, 296, 297, 391, 393; 318/432, 400.02, 801, 811, 609, 632
See application file for complete search history.

(56) References Cited

U.S. PATENT DOCUMENTS 4,380,049 A * 4/1983 Makinen ..... B66B 1/44 187/291
4,441,584 A * 4/1984 Mitsui ..... B66B 1/302 187/296

(Continued)

FOREIGN PATENT DOCUMENTS

JP 61 101578 6/1986
JP 4 85273 3/1992

(Continued)

OTHER PUBLICATIONS

Korean Office Action issued Apr. 7, 2014, in Korea Patent Application No. 10-2013-7008839 (with English translation).

(Continued)

*Primary Examiner* — Anthony Salata
(74) *Attorney, Agent, or Firm* — Oblon, McClelland, Maier & Neustadt, L.L.P.

(57) ABSTRACT

A control device of an elevator improving the speed control performance by performing feedforward compensation. The control device includes a model torque calculating section which calculates, based on a speed instruction value for an electric motor, a model torque instruction value of the electric motor, a storage section which stores the relationship between the speed-dependent loss torque of the electric motor which varies due to variations in the rotation speed of the electric motor and the rotation speed of the electric motor, a speed-dependent loss torque calculating section which calculates, based on a detected value of the rotation speed of the electric motor, a speed-dependent loss torque value correlated to the detected value, and a driving torque calculating section which calculates a torque instruction value by adding the speed-dependent loss torque value correlated to the detected value to the model instruction value.

6 Claims, 8 Drawing Sheets

(56) References Cited

U.S. PATENT DOCUMENTS

| | | | | |
|---|---|---|---|---|
| 5,077,508 | A * | 12/1991 | Wycoff | B66B 1/32 187/292 |
| 6,480,767 | B2 * | 11/2002 | Yamaguchi | B60K 6/46 180/165 |
| 2002/0144968 | A1 * | 10/2002 | Ruddy | B66D 1/46 212/278 |
| 2007/0012521 | A1 | 1/2007 | Sakai et al. | |
| 2007/0096672 | A1 * | 5/2007 | Endo | B62D 5/0472 318/432 |
| 2012/0111670 | A1 * | 5/2012 | Fargo | B66B 1/302 187/247 |
| 2013/0009572 | A1 * | 1/2013 | Byun | H02P 21/06 318/14 |
| 2014/0375234 | A1 * | 12/2014 | Kim | H02P 6/08 318/400.02 |

FOREIGN PATENT DOCUMENTS

| | | |
|---|---|---|
| JP | 4 213571 | 8/1992 |
| JP | 2735365 | 4/1998 |
| JP | 2002 27774 | 1/2002 |
| JP | 2004 10224 | 1/2004 |
| JP | 4230139 | 2/2009 |
| WO | 2005 030627 | 4/2005 |

OTHER PUBLICATIONS

International Search Report Issued Dec. 7, 2010 in PCT/JP10/65231 Filed Sep. 6, 2010.

Office Action issued Jan. 21, 2014 in Japanese Patent Application No. 2012-532748 (with partial English language translation).

International Preliminary Report on Patentability with Written Opinion issued Apr. 18, 2013, in International Application No. PCT/JP2010/065231.

* cited by examiner

CONTROL DEVICE OF ELEVATOR

TECHNICAL FIELD

The present invention relates to a control device of an elevator.

BACKGROUND ART

Model reference follow-up control using mechanical inertia has been proposed as the speed control of a motor which drives an elevator. In this model reference follow-up control, acceleration torque components produced during the acceleration and deceleration of an elevator are compensated for in a feedforward manner (refer to Patent Literature 1, for example).

CITATION LIST

Patent Literature

Patent Literature 1: Japanese Patent No. 4230139

Feedforward-compensated torque is expressed by the following formula in which the elevator car position x and the car load L are used:

$$T(x,L)=T\alpha(L)+Tub(L)+Tcmp(x)+Tloss$$

In this formula, Tα (L) is a torque produced by the elevator during acceleration and deceleration. Tub (L) is a torque produced due to a deviation between the weight of the elevator car and the equipment around the car and the weight of the counterweight. Tcmp (x) is a torque produced by a deviation between the rope weight on the car side and the rope weight on the counterweight side based on the car position x. Tloss is a torque produced by the friction between a roller attached to the car and a rail in the shaft during the movement of the car.

SUMMARY OF INVENTION

Technical Problem

However, in the motor of an elevator, a speed-dependent loss torque which varies due to variations in the speed of the elevator also exists in addition to torque (x, L). For this reason, in the case of high speeds as a super high-speed elevator, feedforward compensation cannot be sufficiently carried out with torque T (x, L). Accordingly, excess or deficiency of torque occurs in the motor. Speed deviations occur in the motor due to this excess or deficiency. As a result, start shocks and speed overshoots occur in the elevator. The ride comfort of the elevator is worsened by this.

The present invention was made to solve the problems described above, and the object of the invention is to provide a control device of an elevator capable of improving the speed control performance of the elevator by appropriately performing feedforward compensation.

Means for Solving the Problems

A control device of the present invention includes a model torque calculating section which calculates, on the basis of a speed instruction value for an electric motor which drives an elevator, a model torque instruction value of the electric motor which is independent of a rotation speed of the electric motor, a storage section which stores a relationship between a speed-dependent loss torque of the electric motor which varies due to variations in the rotation speed of the electric motor and the rotation speed of the electric motor, a speed-dependent loss torque calculating section which calculates, on the basis of a detected value of the rotation speed of the electric motor, a speed-dependent loss torque value correlated to the detected value and a driving torque calculating section which calculates a torque instruction value for driving the electric motor by adding the speed-dependent loss torque value correlated to the detected value to the model instruction value.

Advantageous Effect of Invention

According to the present invention, it is possible to improve the speed control performance of an elevator by appropriately performing feedforward compensation.

DESCRIPTION OF EMBODIMENTS

Embodiments for carrying out the present invention will be described with reference to the accompanying drawings. Incidentally, in each of the drawings, like numerals refer to like or corresponding parts and overlaps of description of these parts are appropriately simplified or omitted.

Embodiment 1

Figure 1:
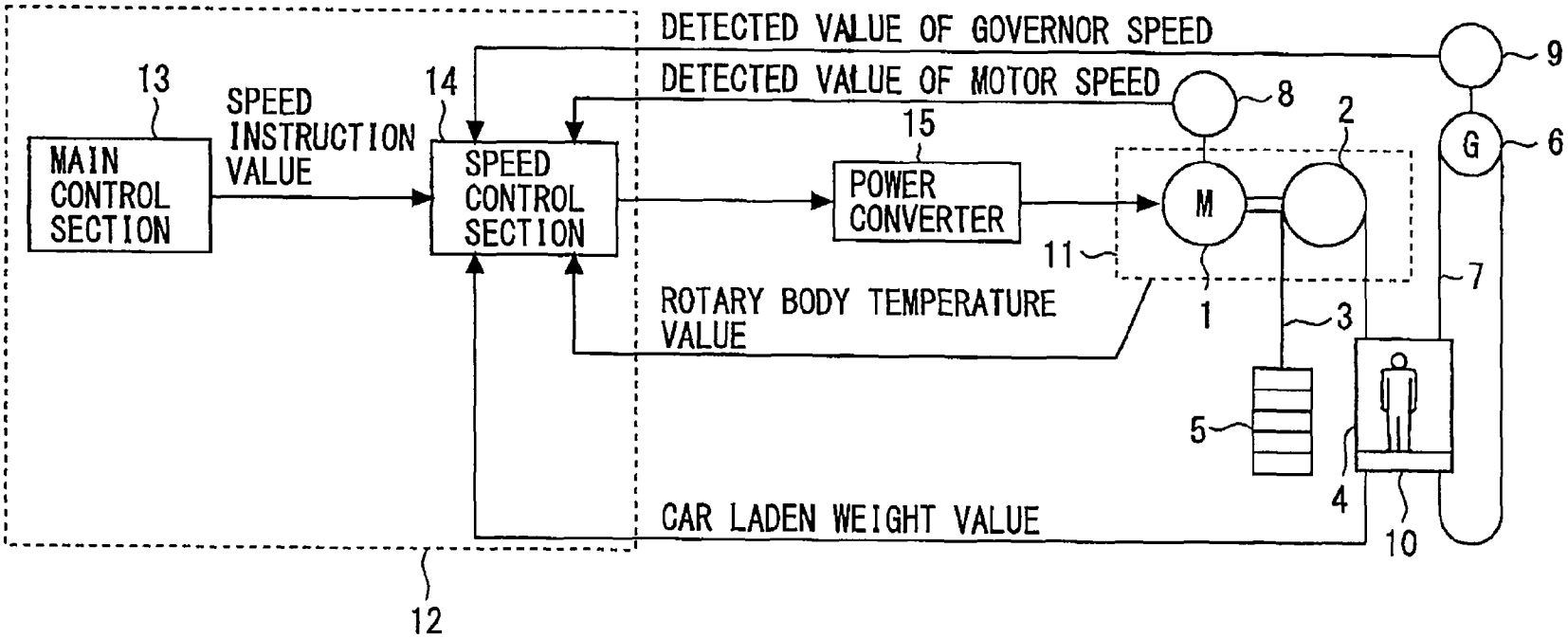
FIG. 1 is a configurational diagram of an elevator in which a control device of an elevator in Embodiment 1 of the present invention is utilized.

FIG. 1 is a configurational diagram of an elevator in which a control device of an elevator in Embodiment 1 of the present invention is utilized.

In FIG. 1, a motor (an electric motor) 1 is provided in the upper part of a shaft (not shown) of an elevator. A sheave 2 is attached to the motor 1. A rope 3 is wound on the sheave 2. A car 4 is suspended from one end of the rope 3. A counterweight 5 is suspended from other end of the rope 3. The counterweight 5 is balanced with the car 4 which is 50% loaded.

A governor 6 is provided in an upper part of the shaft. A governor rope 7 is wound on the governor 6. The governor rope 7 is connected to the car 4.

A motor speed detector 8 is connected to the motor 1. The motor speed detector 8 outputs a detected value of motor speed corresponding to the rotation of the motor 1. A governor speed detector 9 is connected to the governor 6. The governor speed detector 9 outputs a detected value of governor speed corresponding to the rotation of the governor 6.

A weight detection device 10 is provided in the car 4. The weight detection device 10 outputs a car laden weight value corresponding to the weight value of the load in the car 4. A rotary body temperature detection device 11 is provided for the motor 1 and the sheave 2. The rotary body temperature detection device 11 outputs a rotary body temperature value corresponding to the temperature of a rotary body (not shown) which rotates following the rotation of the motor 1 and the sheave 2.

A detected value of motor speed, a detected value of governor speed, a car laden weight value, and a rotary body temperature value are inputted to a control device proper 12. A main control section 13 of the control device proper 12 outputs a speed instruction value corresponding to the operation of the elevator. The speed instruction value is inputted to a speed control section 14 of the control device proper 12. The speed control section 14 of the control device proper 12 calculates a torque instruction value (not shown) on the basis of a speed instruction value, a detected value of motor speed, a detected speed of governor speed, a car laden weight value, and a rotary body temperature value.

A torque instruction value is inputted to a power converter 15. The power converter 15 is driven on the basis of a torque instruction value. As a result of this driving, power is supplied to the motor 1. The motor 1 is driven by this power supply. The sheave 2 is rotated by this driving. The rope 3 is moved by this rotation. The car 4 and the counterweight 5 are caused to ascend and descend in opposite directions by this movement.

Next, the speed control section 14 of the control device proper 12 will be described with the aid of FIG. 2.

Figure 2:
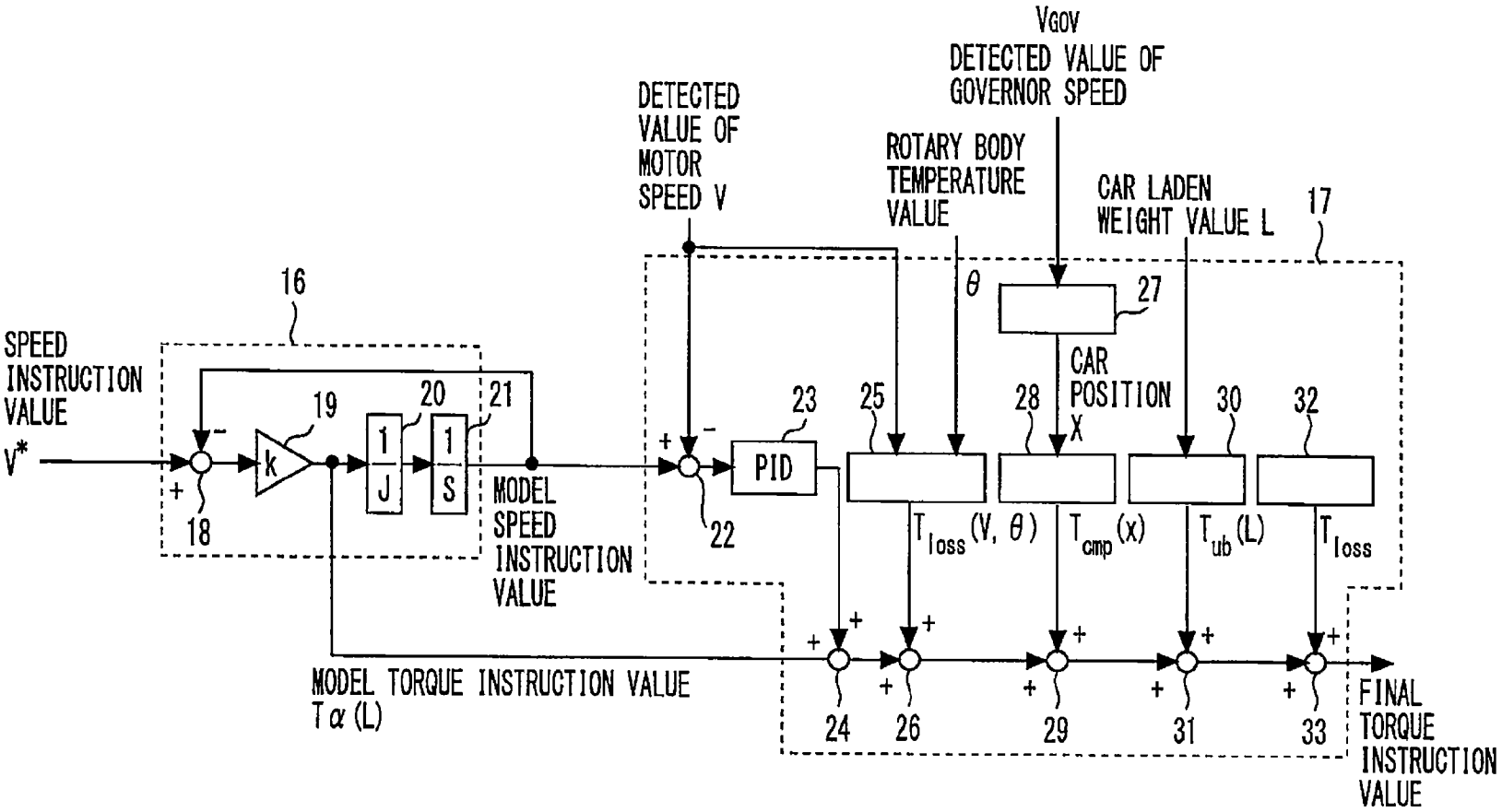
FIG. 2 is a block diagram of the speed control section of the control device of an elevator in Embodiment 1 of the present invention.

FIG. 2 is a block diagram of the speed control section of the control device of an elevator in Embodiment 1 of the present invention.

As shown in FIG. 2, the speed control section 14 includes a model torque calculating section 16 and a torque compensation section 17.

First, the model torque calculating section 16 will be described.

The model torque calculating section 16 includes a first subtracter 18, a gain multiplier 19, an inertia multiplier 20, and an integrator 21.

The gain multiplier 19 calculates a model torque instruction value Tα (L) by multiplying a calculated value of the first subtracter 18 by a proportional gain K. The inertia multiplier 20 multiplies a model torque instruction value Tα (L) by an inverse number of a model inertia J from an inertia calculating section (not shown). The integrator 21 calculates a model speed instruction value by integrating a calculated value of the inertia multiplier 20. In this manner, the model torque calculating section 16 functions also as a model speed calculating section which calculates a model speed instruction value.

A speed instruction value V* is inputted to one input terminal of the first subtracter 18 from the main control section 13. A model speed instruction value is inputted to the other input terminal of the first subtracter 18 from the integrator 21. The first subtracter 18 calculates a difference between the speed instruction value V* and the model speed instruction value. For this reason, the gain multiplier 19 calculates a model torque instruction value Tα (L) on the basis of the difference calculated by the first subtracter 18.

At this time, the smaller the difference calculated by the first subtracter 18, the smaller the model torque instruction value Tα (L) is. And when the difference calculated by the first subtracter 18 becomes zero, also the model torque instruction value Tα (L) becomes zero. That is, the model torque instruction value Tα (L) is calculated so that the model speed instruction value follows the speed instruction value V*.

Various kinds of loss torques and the like are not considered in the model torque instruction value Tα (L) and the model speed instruction value. Therefore, various kinds of loss torques and the like are considered by the torque compensation section 17, and a final torque instruction value for driving the motor 1 is calculated. The torque compensation section 17 is described below.

The torque compensation section 17 includes a second subtracter 22, a PID controller (a proportional-integral-derivative controller) 23, a first adder 24, a first compensator (a speed/temperature-dependent loss torque calculating section) 25, a second adder 26, a car position detector 27, a second compensator (a rope imbalance torque calculating section) 28, a third adder 29, a third compensator (a car imbalance torque calculating section) 30, a fourth adder 31, a fourth compensator (a speed/temperature-independent loss torque calculating section) 32, and a fifth adder (a driving torque calculating section) 33.

A model speed instruction value is inputted to one input terminal of the second subtracter 22 from the integrator 21. A detected value of motor speed V is inputted to the other input terminal of the second subtracter 22 from the motor speed detector 8. The second subtracter 22 calculates a difference between the model speed instruction value and the detected value of motor speed V.

A calculated value of the second subtracter 22 is inputted to the PID controller 23. The PID controller 23 performs the proportional-integral-derivative action of a calculated value of the second subtracter 22 and functions as a compensation calculating section for calculating an error-compensated torque value (not shown).

A model torque instruction value Tα (L) is inputted to one input terminal of the first adder 24 from the gain multiplier 19. An error-compensated torque value is inputted to the other input terminal of the first adder 24 from the PID controller 23. The first adder 24 calculates a preliminary torque instruction value (not shown) by adding the error-compensated torque value to the model torque instruction value Tα (L).

A detected value of motor speed V is inputted to one input terminal of the first compensator 25 from the motor speed detector 8. A rotary body temperature value θ is inputted to the other input terminal of the first compensator 25 from the rotary body temperature detection device 11. On the basis of the detected value of motor speed V and the rotary body temperature value θ, the first compensator 25 calculates a first compensation value (speed/temperature-dependent loss torque compensation value) Tloss (V, θ) which varies due to variations in the rotation speed of the motor 1 and the rotary body temperature of the motor 1 and the like.

A preliminary torque instruction value is inputted to one input terminal of the second adder 26 from the first adder 24. A first loss torque compensation value Tloss (V, θ) is inputted to the other input terminal of the second adder 26 from the first compensator 25. The second adder 26 calculates a first torque instruction value (not shown) by adding the first compensation value Tloss (V, θ) to the preliminary torque instruction value.

A detected value of governor speed $V_{GOV}$ is inputted to the car position detector 27 from the governor speed detector 9. The car position detector 27 calculates the car position x by integrating the detected value of governor speed $V_{GOV}$.

Information on the car position x is inputted to the second compensator 28 from the car position detector 27. On the basis of the car position x, the second compensator 28 calculates a second compensation value (a rope imbalance torque compensation value) Tcmp (x) occurring due to a deviation between the weight of the rope 3 on the car 4 side and the weight of the rope 3 on the counterweight 5 side.

A first torque instruction value is inputted to one input terminal of the third adder 29 from the second adder 26. A second compensation value Tcmp (x) is inputted to the other input terminal of the third adder 29 from the second compensator 28. The third adder 29 calculates a second torque instruction value (not shown) by adding the second compensation value Tcmp (x) to the first torque instruction value.

A car laden weight value L is inputted to the third compensator 30 from the weight detection device 10. The third compensator 30 calculates an imbalance weight value, which is a difference between the car laden weight value L and the weight value of the counterweight 5. The third compensator 30 calculates a third compensation value (an imbalance torque compensation value) Tub (L) on the basis of the imbalance weight value.

A second toque instruction value is inputted to one input terminal of the fourth adder 31 from the third adder 29. A third compensation value Tub (L) is inputted to the other input terminal of the fourth adder 31 from the third compensator 30. The fourth adder 31 calculates a third torque instruction value (not shown) by adding third compensation value Tub (L) to the second toque instruction value.

The fourth compensator 32 calculates a fourth compensation value Tloss which is independent of the rotation speed of the motor 1 and the rotary body temperature of the motor 1 and the like.

A third torque instruction value is inputted to one input terminal of the fifth adder 33 from the fourth adder 31. A fourth compensation value Tloss is inputted to the other input terminal of the fifth adder 33 from the fourth compensator 32. The fifth adder 33 calculates a final torque instruction value by adding the fourth compensation value Tloss to the third torque instruction value. The final torque instruction value is outputted to the power converter 15.

According to this speed control section 14, the final torque instruction value is expressed by the following formula (1):

$$T(x,L)=T\alpha(L)+Tub(L)+Tcmp(x)+Tloss+Tloss(V,\theta) \quad (1)$$

In this formula, if the rotation speed of the motor 1 is low, the first compensation value Tloss (V, θ) can be neglected. Therefore, if the rotation speed of the motor 1 is made low, the model torque instruction value Tα (L), the second compensation value Tcmp (x), the third compensation value Tub (L), and the fourth compensation value Tloss can be calculated by the same method as described in Japanese Patent No. 4230139 and the like.

However, in a super high-speed elevator and a large-capacity elevator, the first compensation value Tloss (V, θ) cannot be neglected. For this reason, it is necessary to appropriately calculate the first compensation value Tloss (V, θ). A method of calculating the first compensation value Tloss (V, θ) will be described below with the aid of FIG. 3.

Figure 3:
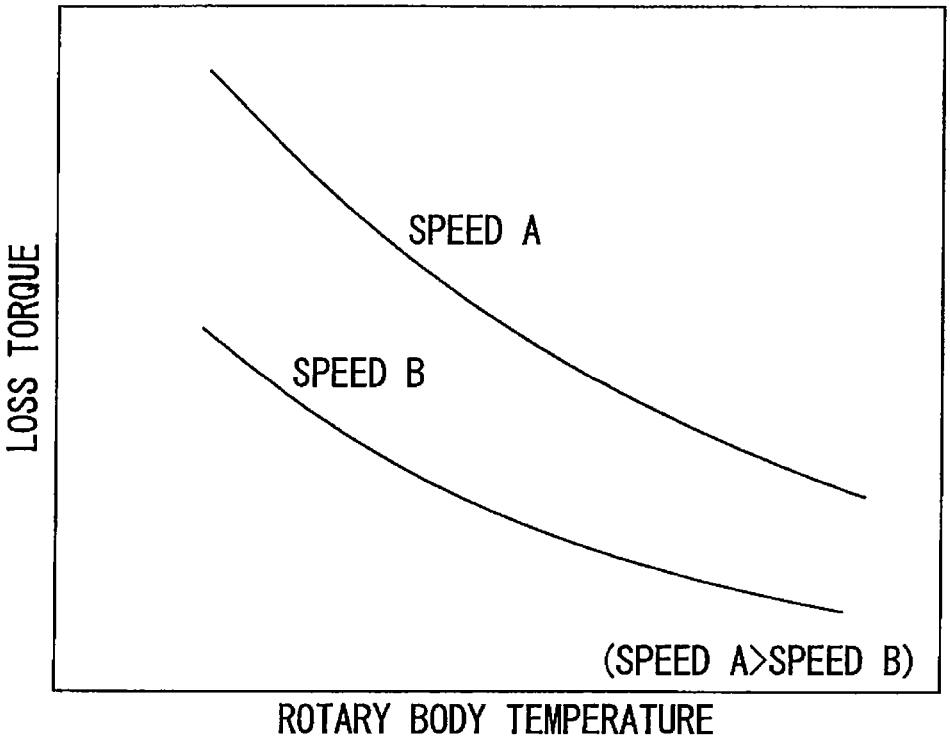
FIG. 3 is a diagram to explain the loss torque compensation value utilized in the control device of an elevator in Embodiment 1 of the present invention.

FIG. 3 is a diagram to explain the loss torque compensation value utilized in the control device of an elevator in Embodiment 1 of the present invention.

The abscissa indicates rotary body temperature and the ordinate indicates loss torque in FIG. 3.

A bearing loss of a rotary body, such as the motor 1 and the sheave 2, is conceivable as a loss torque which varies due to variations in the rotation speed of the motor 1. Also a loss due to the friction between the sheave 2 and the rope 3 is conceivable. In contrast to this, a loss torque corresponding to the stirring resistance of a viscous component of grease and the like utilized for the rotation of a rotary body is conceivable as a loss torque which varies due to variations in the rotary body temperature.

As shown in FIG. 3, the higher the rotation speed of the motor 1, the larger a total of these loss torques, and the lower the rotary body temperature, the larger a total of these loss torques. These relationships differ from one elevator system to another.

Accordingly, in this embodiment, the relationship between the rotary body temperature for each speed of the elevator and loss torque is sampled by driving the elevator. This relationship is stored in a storage section (not shown) of the first compensator 25. For this relationship, the first compensation value Tloss (V, θ) is calculated by inputting the detected value of motor speed V and the rotary body temperature value θ. On the basis of this calculation result, speed-dependent loss torque component and a temperature-dependent loss torque component of the motor 1 are compensated for as feedforward components.

According to Embodiment 1 described above, a final torque instruction value is obtained by adding a speed-dependent loss torque compensation value to a model torque instruction value. For this reason, it is possible to improve the speed control performance of the motor 1 by appropriately performing feedforward compensation. That is, the excess or deficiency of the torque of the motor 1 becomes less apt to occur and the speed deviation component of the motor 1 becomes small.

Also an error-compensated torque value is added to the final torque value. However, the speed deviation component of the motor 1 has become small. For this reason, start shocks of the elevator and speed overshoots during acceleration and deceleration can be prevented. As a result, it is possible to improve the ride comfort of the elevator.

In particular, it is possible to supply an appropriate imbalance torque during the release of the brake of the elevator. As a result, it is possible to eliminate start shocks which occur during the release of the brake.

In addition, also a temperature-dependent loss torque compensation value is added to the final torque instruction value. For this reason, it is possible to further improve the speed control performance of the motor 1. This enables the ride comfort of the elevator to be improved further.

Embodiment 2

Figure 4:
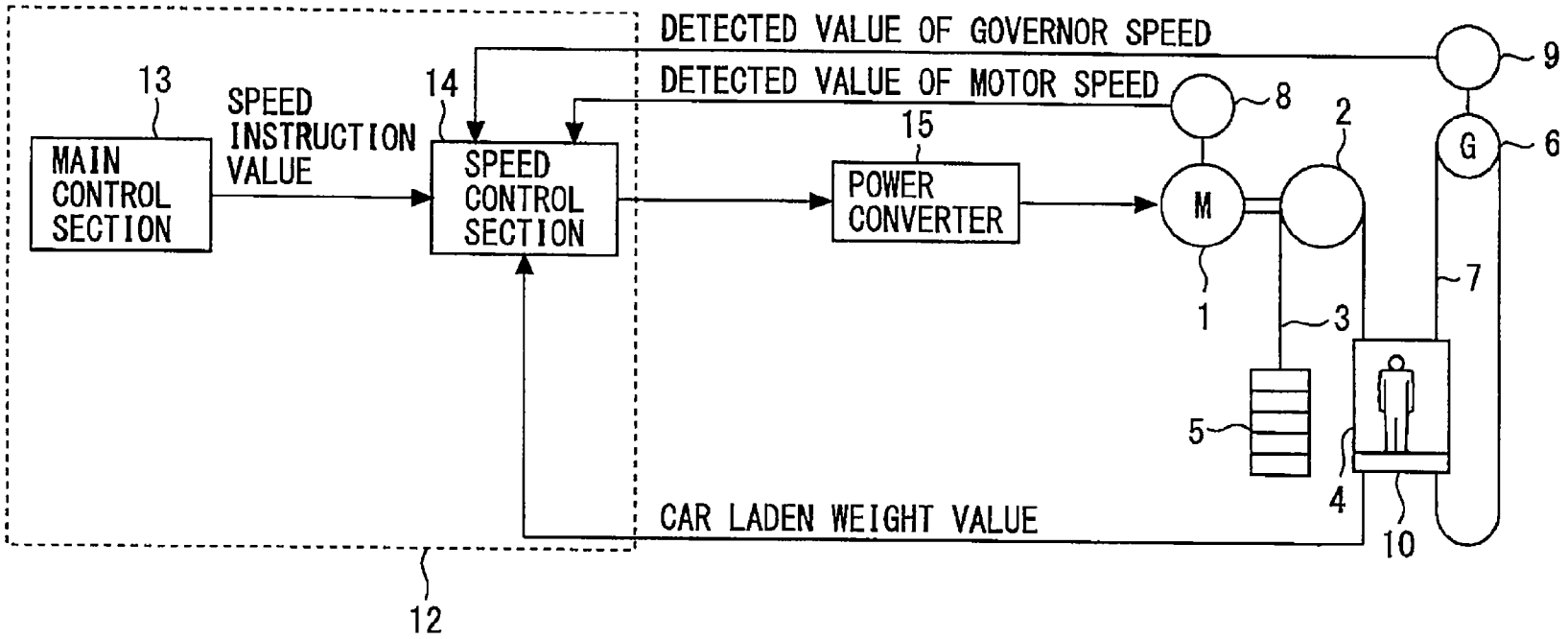
FIG. 4 is a configurational diagram of an elevator in which the control device of an elevator in Embodiment 2 of the present invention is utilized.

FIG. 4 is a configurational diagram of an elevator in which the control device of an elevator in Embodiment 2 of the present invention is utilized. Incidentally, like numerals refer to the same parts as in Embodiment 1 or corresponding parts and descriptions thereof are omitted.

In Embodiment 1, the rotary body temperature is detected by utilizing the rotary body temperature detection device 11. On the other hand, in Embodiment 2, the rotary body temperature is estimated without utilizing the rotary body temperature detection device 11.

Figure 5:
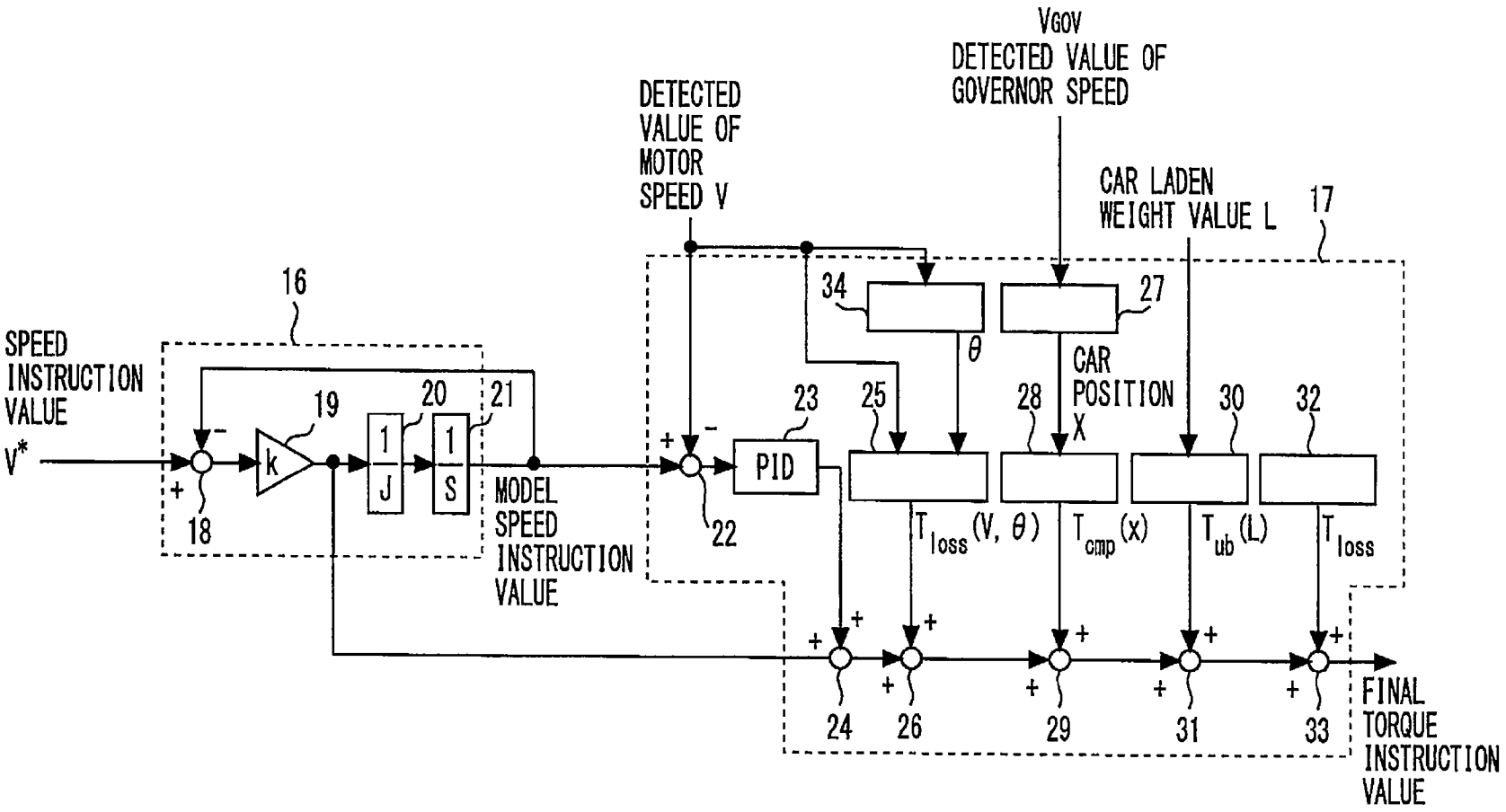
FIG. 5 is a block diagram of a speed control section of a control device of an elevator in Embodiment 2 of the present invention.

FIG. 5 is a block diagram of a speed control section of a control device of an elevator in Embodiment 2 of the present invention.

As shown in FIG. 5, in Embodiment 2 a rotary body temperature estimator 34 is provided. The rotary body temperature estimator 34 estimates the rotary body temperature value θ by utilizing the fact that the temperature of a viscous component in a rotary body varies depending on the amount of work of the elevator.

Figure 6:
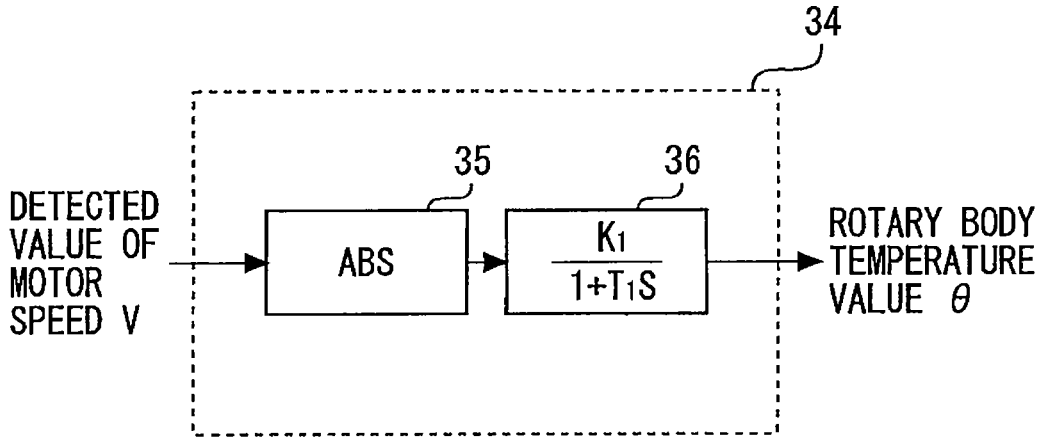
FIG. 6 is a diagram to explain the rotary body temperature estimator utilized in the speed control section of the control device of an elevator in Embodiment 2 of the present invention.

FIG. 6 is a diagram to explain the rotary body temperature estimator utilized in the speed control section of the control device of an elevator in Embodiment 2 of the present invention.

The rotary body temperature estimator 34 includes an absolute value calculator 35 and a primary delay filter 36.

A detected value of motor speed V is inputted to the absolute value calculator 35. The absolute value calculator 35 calculates an absolute value of the detected value of motor speed V. An absolute value of a detected value of motor speed V is inputted to the primary delay filter 36 from the absolute value calculator 35. The primary delay filter 36 calculates an estimated value of the rotary body temperature value θ on the basis an absolute value of a detected value of motor speed V, a proportional constant $K_1$, and a time constant $T_1$. The proportional constant $K_1$ and the time constant $T_1$ are determined by adding a thermal time constant of a viscous component of a rotary body and the like.

According to Embodiment 2 described above, it is possible to calculate the temperature-dependent loss torque compensation value without using the rotary body temperature detection device 11. For this reason, it is possible to simplify the equipment configuration.

Embodiment 3

Figure 7:
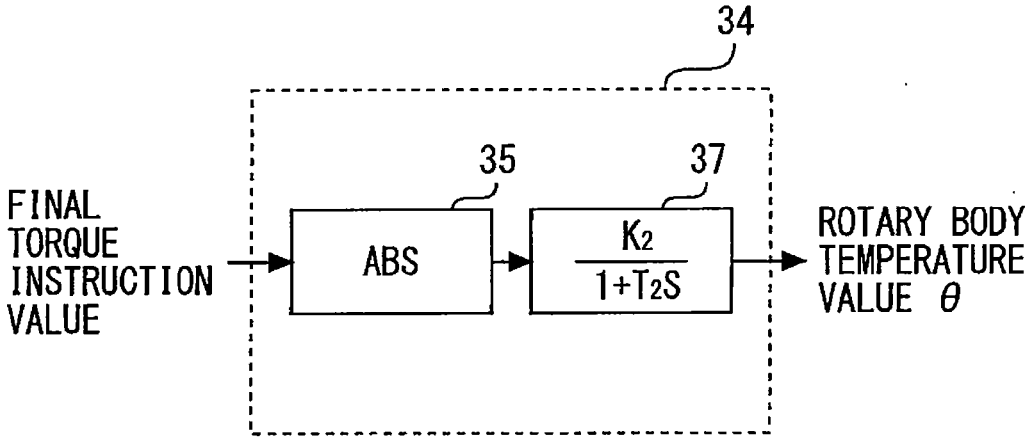
FIG. 7 is a diagram to explain a rotary body temperature estimator utilized in the speed control section of the control device of an elevator in Embodiment 3 of the present invention.

FIG. 7 is a diagram to explain a rotary body temperature estimator utilized in the speed control section of the control device of an elevator in Embodiment 3 of the present invention. Incidentally, like numerals refer to the same parts as in Embodiment 2 or corresponding parts and descriptions thereof are omitted.

In Embodiment 2 a detected value of motor speed V is inputted to the rotary body temperature estimator 34. On the other hand, in Embodiment 3 a final torque instruction value is inputted to the rotary body temperature estimator 34. In this case, the setting of the primary delay filter 37 differs from the setting of the primary delay filter 36 in Embodiment 2. Specifically, the proportional constant $K_2$ and the time constant $T_2$ are set in the primary delay filter 37. Also these constants are determined by adding the thermal time constant of a viscous component of a rotary body and the like.

According to Embodiment 3 described above, in the same manner as in Embodiment 2, it is possible to calculate the temperature-dependent loss torque compensation value without using the rotary body temperature detection device 11. For this reason, it is possible to simplify the equipment configuration.

Embodiment 4

Figure 8:
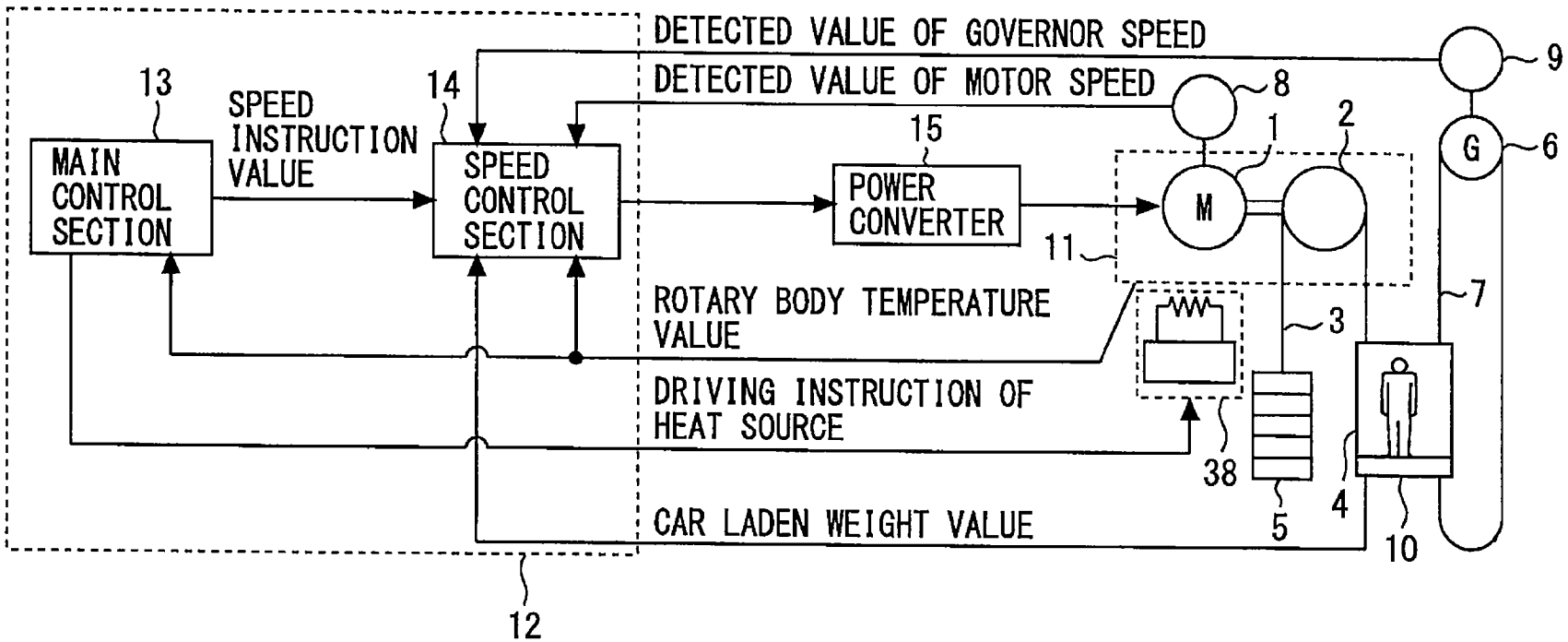
FIG. 8 is a configurational diagram of an elevator in which a control device of an elevator in Embodiment 4 of the present invention is utilized.

FIG. 8 is a configurational diagram of an elevator in which a control device of an elevator in Embodiment 4 of the present invention is utilized. Incidentally, like numerals refer to the same parts as in Embodiment 1 or corresponding parts and descriptions thereof are omitted.

In the elevator of Embodiment 4, a heat source 38 is added to the elevator of Embodiment 1. The heat source 38 is provided in the vicinity of a rotary body, such as the motor 1.

Next, with the aid of FIG. 9 a description will be given of the function added to the main control section 13 of the control device proper 12.

Figure 9:
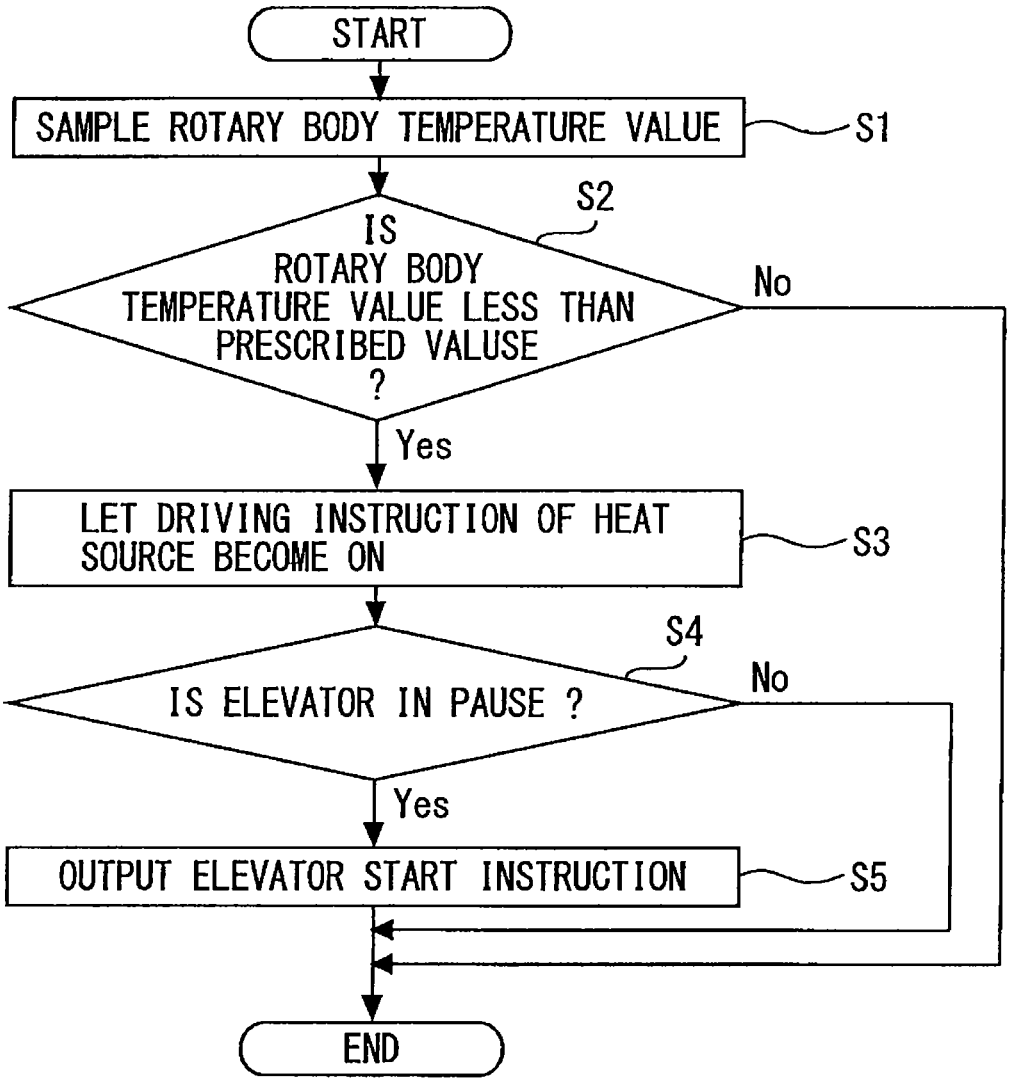
FIG. 9 is a flowchart to explain the function of the control device of an elevator in Embodiment 3 of the present invention.

FIG. 9 is a flowchart to explain the function of the control device of an elevator in Embodiment 3 of the present invention.

First, in Step S1, rotary temperature values are sampled. After that, the flow of actions proceeds to Step S2, where a determination is made as to whether or not a rotary body temperature value is less than a prescribed value. The action is finished in the case where the rotary body temperature is not less than the prescribed value.

In contrast to this, in the case where the rotary body temperature is less than the prescribed value, the flow of actions proceeds to Step S3. In Step S3, the driving instruction of the heat source 38 becomes ON. The heat source 38 is driven under this instruction. The rotary body temperature rises due to this driving.

After that, in Step S4 a determination is made as to whether or not the elevator is in a pause. In the case where the elevator is not in a pause, the action is finished. In contrast to this, in the case where the elevator is in a pause, the flow of actions proceeds to Step S5. In Step S5, an elevator start instruction is outputted and the action is finished.

A speed instruction value corresponding to this start instruction is outputted. The speed control section 14 outputs a final torque instruction value on the basis of this speed instruction value. The power converter 15 drives the motor 1 on the basis of this final torque instruction value. A rotary body rotates following this driving. The rotary body temperature rises due to this rotation.

According to Embodiment 3 described above, the rotary body temperature rises in the case where the rotary body temperature value is less than a prescribed value. For this reason, the stirring resistance of a viscous component utilized in the rotary body decreases. This decrease enables the loss torque of the motor 1 to be reduced. As a result, it is possible to reduce the output of the motor 1. For this reason, even in the case where the surrounding environmental temperature of the machine room and the like of the elevator is low, it is possible to utilize a motor 1 of small capacity.

INDUSTRIAL APPLICABILITY

As described above, the control device of an elevator of the present invention can be utilized in an elevator in which speed control performance is improved.

DESCRIPTION OF SYMBOLS

1 motor
2 sheave
3 rope
4 car
5 counterweight
6 governor
7 governor rope
8 motor speed detector
9 governor speed detector
10 weight detection device
11 rotary body temperature detection device
12 control device proper
13 main control section
14 speed control section

15 power converter
16 model torque calculating section
17 torque compensation section
18 first subtracter
19 gain multiplier
20 inertia multiplier
21 integrator
22 second subtracter
23 PID controller
24 first adder
25 first compensator
26 second adder
27 car position detector
28 second compensator
29 third adder
30 third compensator
31 fourth adder
32 fourth compensator
33 fifth adder
34 rotary body temperature estimator
35 absolute value calculator
36, 37 primary delay filter
38 heat source

The invention claimed is:

1. A control device of an elevator, comprising:

a model torque calculating section which calculates, on the basis of a speed instruction value for an electric motor which drives an elevator, a model torque instruction value of the electric motor which is independent of a rotation speed of the electric motor;

a storage section which stores a relationship between a speed-dependent loss torque of the electric motor which varies due to variations in the rotation speed of the electric motor and the rotation speed of the electric motor;

a speed-dependent loss torque calculating section which calculates, on the basis of a detected value of the rotation speed of the electric motor, a speed-dependent loss torque value correlated to the detected value; and a driving torque calculating section which calculates a torque instruction value for driving the electric motor by adding the speed-dependent loss torque value correlated to the detected value to the model instruction value.

2. The control device of an elevator according to claim 1, further comprising:

a model speed calculating section which calculates, on the basis of the speed instruction value, the model speed instruction value of the electric motor which is independent of the rotation speed of the electric motor; and a compensation calculating section which calculates, on the basis of a difference between the model speed instruction value and the detected value of the rotation speed of the electric motor, an error-compensated torque value, wherein the model torque calculating section calculates the model torque instruction value so that the model speed instruction value follows the speed instruction value, and wherein the driving torque calculating section calculates the torque instruction value by adding the error-compensated torque value to the model torque instruction value.

3. The control device of an elevator according to claim 1, further comprising:

a temperature detection device which detects a temperature of a rotary body which rotates by following the rotation of the electric motor; and a temperature-dependent loss torque calculating section which calculates, on the basis of a temperature value of the rotary body, a temperature-dependent loss torque value of the electric motor which varies due to temperature variations of a viscous component utilized in the rotary body, wherein the driving torque calculating section calculates the torque instruction value by adding the temperature-dependent loss torque value to the model torque instruction value.

4. The control device of an elevator according to claim 1, further comprising:

an estimation section which estimates, on the basis of a detected value of the rotation speed of the electric motor, a temperature of a rotary body which rotates by following the electric motor; and a temperature-dependent loss torque calculating section which calculates, on the basis of a temperature value of the rotary body, the temperature-dependent loss torque value of the electric motor which varies due to the temperature variations of the viscous component utilized in the rotary body, wherein the driving torque calculating section calculates the torque instruction value by adding the temperature-dependent loss torque value to the model torque instruction value.

5. The control device of an elevator according to claim 2, further comprising:

a heat source which warms the rotary body in the case where the temperature value of the rotary body is less than a prescribed value.

6. The control device of an elevator according to claim 2, further comprising:

a main control section which drives the electric motor in the case where the temperature value of the rotary body is less than a prescribed value when the electric motor is stopped.

* * * * *